US005277129A

United States Patent [19]

Korb

[11] Patent Number: 5,277,129

[45] Date of Patent: Jan. 11, 1994

[54] WORK TABLE OR OFFICE DESK

[75] Inventor: Daniel Korb, Sindelfingen, Fed. Rep. of Germany

[73] Assignee: Dyes GmbH, Fed. Rep. of Germany

[21] Appl. No.: 930,920

[22] Filed: Aug. 17, 1992

[30] Foreign Application Priority Data

Aug. 16, 1991 [DE] Fed. Rep. of Germany ..... 4127082

[51] Int. Cl.[5] ..... A47F 5/12

[52] U.S. Cl. ..... 108/4; 108/9

[58] Field of Search ..... 108/4, 9

[56] References Cited

U.S. PATENT DOCUMENTS 5,086,710 2/1992 Korb .

FOREIGN PATENT DOCUMENTS

| | | | |
|---|---|---|---|
| 0122018 | 2/1946 | Sweden | 108/4 |
| 0109500 | 4/1924 | Switzerland | 108/9 |
| 0356041 | 9/1961 | Switzerland | 108/9 |
| 0008602 | of 1907 | United Kingdom | 108/4 |

*Primary Examiner*—Kenneth J. Dorner
*Assistant Examiner*—Gerald A. Anderson
*Attorney, Agent, or Firm*—Speckman, Pauley & Fejer

[57] ABSTRACT

A work table or office desk having two pairs of support arms which are pivotable attached on a cross brace of the table frame. The support arms comprise two support arm halves which enclose each one of two rails of the cross brace by grooves such that the support arm is captively maintained, but can be adjusted at a preset pivot angle. A definite lockable setting of the support arms in the set pivot position is obtained in a simple manner where at least one support arm half of each support arm is provided with a denticulation in the area of the groove, the segment element has a counter-denticulation which is in engagement with the denticulation of the support arm half, and a pre-stressed resilient element, in a loosened state of a bolt connection holding said support arm halves together, pulls the support arm halves together and adjustably maintains a functional connection of the denticulation and the counter-denticulation by a limited resilience.

6 Claims, 3 Drawing Sheets

WORK TABLE OR OFFICE DESK

BACKGROUND OF THE INVENTION

1. Field of the Invention

This invention relates to a work table or office desk with a work surface which is adjustable in height or inclination and is hingedly supported on a cross brace of the table frame by two pairs of pivotable support arms. Each support arm is vertically divided into two support arm halves, each of which forms a concave groove in the shape of a section of an arc at their ends facing the cross brace. The undercut groove of each support arm half is aligned parallel to the cross brace, enclosing a convex, undercut rail of a segment element in the shape of a section of an arc and is aligned parallel to the cross brace. The segment element is vertically aligned and laid out on the pivot area of the assembled support arm. The two support arm halves of each support arm are connected to each other by bolt connections and are captively maintained on the segment element.

2. Description of the Prior Art

A work table or office desk of this type is known from German Patent Publication DE 40 28 456 C1. In this case the lay-out of the grooves of the support arm halves and the rails of the segment elements in relation to the bolt connection is such that when the bolt connections are tightened, the grooves of the support arm halves and the rails of the segment elements are braced against each other. With the bolt connections loosened, the support arms can be pivoted on the segment elements and the height and/or the inclination of the work surface can be changed in this manner.

It has been shown that bracing of the support arms on the segment elements as taught by the prior art does not suffice when the work surface is placed under a substantial load.

SUMMARY OF THE INVENTION

It is an object of this invention to improve a work table or office desk without undue additional structural expenditures such that the load on the work surface can be considerably increased without fear that the setting of the support arms and, thus, the height and/or inclination of the work surface, are changed.

This object is attained in accordance with one embodiment of this invention where at least one support arm half of each support arm is provided with a denticulation in the area of the groove and the associated segment element has a counter-denticulation which engages this denticulation of the support arm half. A prestressed resilient element is provided which, when the bolt connection is loosened, pulls the support arm halves against each other and adjustably maintains the functional connection between the denticulation and counter-denticulations due to its limited elasticity.

In accordance with one embodiment of this invention, only the segment elements and the support arm halves are provided with additional denticulations. These denticulations are engaged with each other and permit a stepwise change of the pivot positions of the support arms.

In accordance with one embodiment of this invention, the support arm is maintained in its position even after loosening the bolt connection. The support arms are displaced in the denticulations of the segment elements only by pushing or pulling the table top. This is accomplished as the two support arm halves are pulled towards each other by the resilient element. The spring effect of the resilient element is such that the denticulations of the segment elements can be jumped by the counter-denticulations of the support arm halves. Once the bolt connection has again been tightened, the spring effect of the resilient element is canceled. The two support arm halves are pressed against the segment elements. The amount of pressure of the resilient element, and thus the amount of engagement of the support arm halves with the segment elements, can be adjusted by the bolt connection. This has the important advantage that the spring force can be adapted to the weight of different tops.

In addition, a frictional connection between the support arms and the segment elements is achieved, which mainly results in advantages in view of the permanent load on the work table or office desk.

In accordance with one embodiment of this invention, the denticulations of the support arm halves are disposed in the bottom of the groove and the counter-denticulations of the segment elements are disposed on the front faces of the rails. In this manner, a symmetrical transfer of force in the engagement area between the support arm halves and the segment elements is attained.

In accordance with one embodiment of this invention, the closely stepped adjustment of the support arms with definite locking of the pivot position is attained where the teeth and the tooth gaps of the circular-arc-shaped denticulations of the support arm halves and the circular-arc-shaped counter-denticulations of the segment elements are oriented perpendicular to the longitudinal axis of the cross brace and are radially aligned with respect to the center axis of the circular arcs of the denticulations and counter-denticulations.

In accordance with one embodiment of this invention, the resilient element is maintained in a pre-stressed manner by a nut on a threaded part of a bolt connecting the two support arm halves. A sleeve nut screwed on the threaded part is supported in a receptacle of the facing support arm half and is at a distance from the nut.

BRIEF DESCRIPTION OF THE DRAWINGS

The invention will be described in detail by means of an exemplary embodiment illustrated in the drawings wherein.

DESCRIPTION OF PREFERRED EMBODIMENTS

Figure 1:
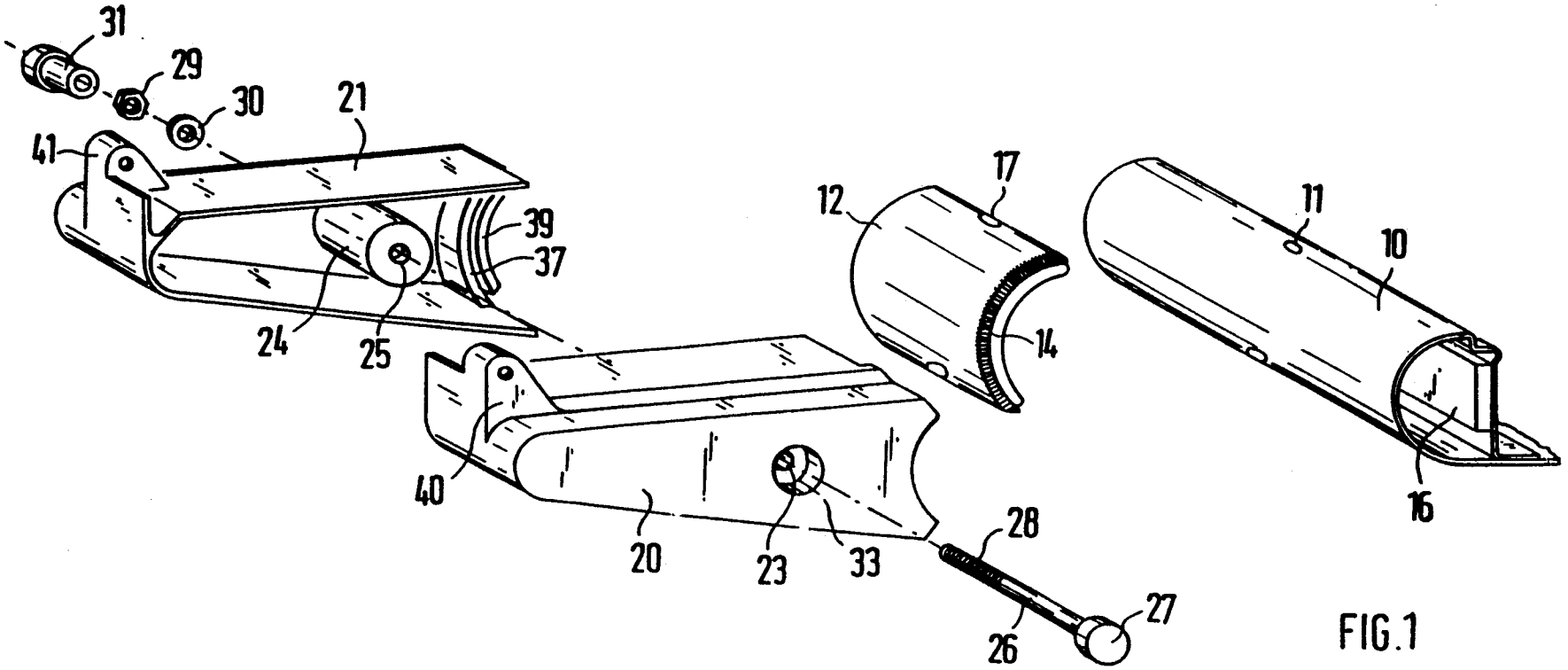
FIG. 1 is an exploded view of the parts for attaching a support arm to the cross brace of a table frame in accordance with one embodiment of this invention.
Figure 2:
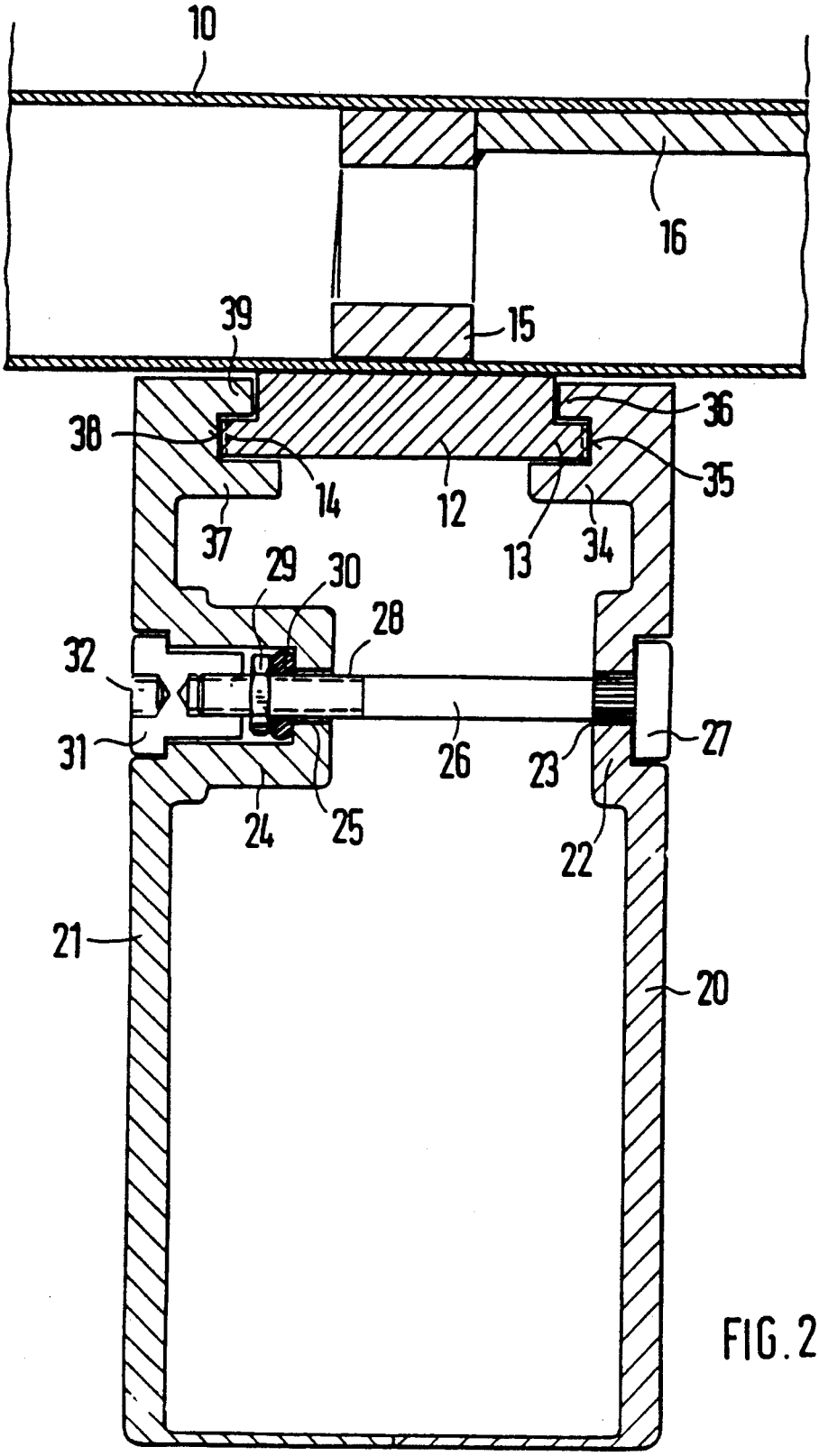
FIG. 2 is a cross-sectional view of the support arm attached to the cross brace in accordance with one embodiment of this invention.
Figure 3:
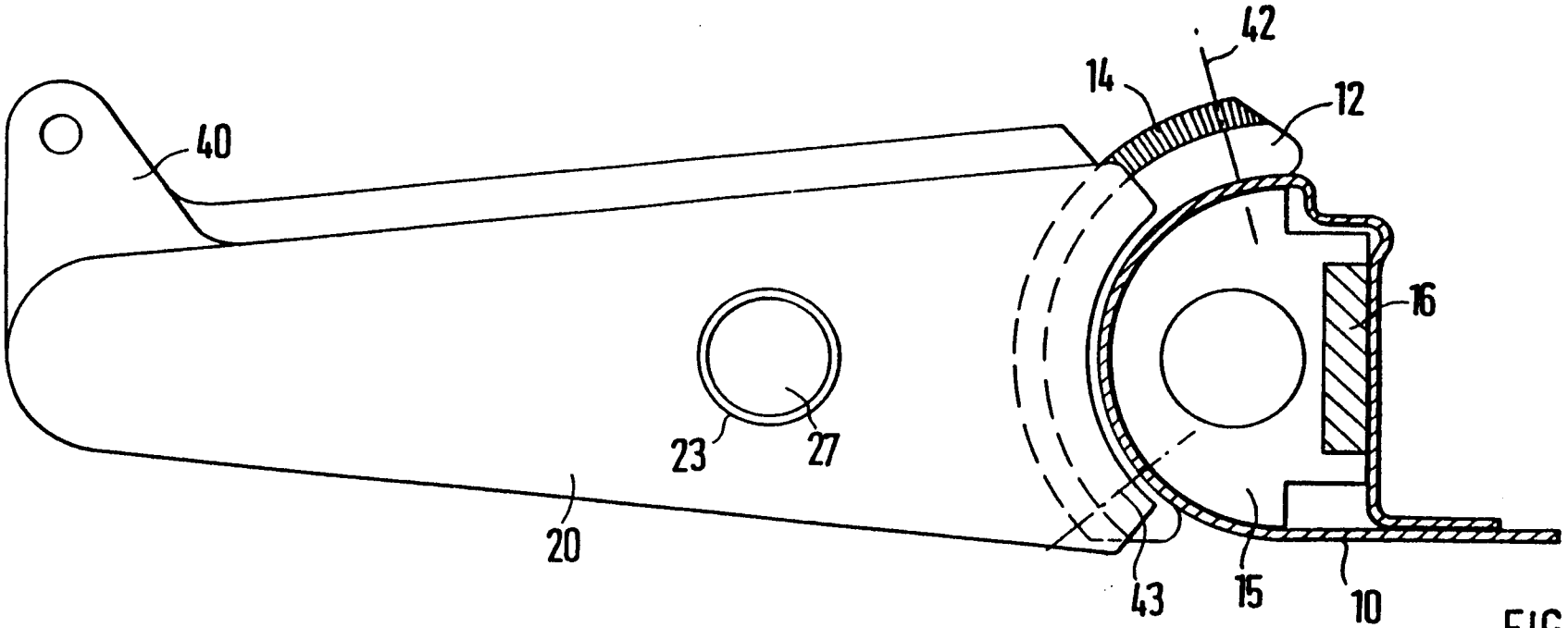
FIG. 3 is a side view of the support arm attached to the segment element of a cross brace in accordance with one embodiment of this invention.

Of the table frame of the work table or office desk, only a cut-out section of a cross brace is shown in FIG. 1, which is embodied as a hollow body along its long sides and thus can receive a connector 15 fastened on a plate 16, as shown in the cross-sectional view in FIG. 2. A segment element 12 can be bolted to the cross brace 10 by bolt connections 42 and 43, the cross brace 10 having holes 11 and the segment element 12 having securing bores 17 for securing bolts.

The segment element 12 is convex and shaped as a section of an arc, as shown in FIG. 2, and is vertically aligned on the cross brace 10. Rails extending from both sides of the segment element 12 are aligned parallel to the longitudinal axis of the cross brace 10 and support a denticulation 14 on their front faces. The teeth and tooth gaps of these denticulations 14 are aligned perpendicularly to the longitudinal axis of the cross brace 10 and are radially aligned toward the center of the circular arc of the denticulations 14. A segment element 12 is attached to each place on the cross brace 10 where a support arm is to be attached. Thus, two segment elements 12 are attached on each long side of the cross brace 10 and pivotably connected to support arms to support the work surface adjustably in height and/or inclination.

As shown in FIG. 2, each support arm comprises two shell-shaped support arm halves 20 and 21. The open sides of the support arm halves 20 and 21 face each other and are connected to each other by a bolt 26. The support arm half 20 has a cup-shaped receptacle 23 for the bolt head 27 cut into it and forms a through-bore for the bolt 26. The bolt head 27 is recessed in the receptacle 23 and is flush with the outside of the support arm half 20. The support arm half 21 comprises a doubly offset, cup-shaped receptacle 25, which not only has a bore for the bolt 26, but also receives an O-ring 30, a nut 29 and a sleeve nut 31. Like the nut 29, the sleeve nut 31 is screwed on a threaded part 28 of the bolt 26. The sleeve nut 31 has a tool receptacle 32 on its front, closes off the receptacle 25 flush with the outside of the support arm half 21 and is supported in the set-off receptacle 25 of the support arm half 21.

Pre-stressing of a resilient element, embodied as the O-ring 30, is accomplished by the nut 29. Pre-stressing is provided such that, with the sleeve nut 31 loosened, the screw connection between the two support arm halves 20 and 21 is loosened so that the counter-denticulations 35 and 38 of the support arm halves 20 and 21 are only supported in the denticulations 14 of the segment element 12 by the pre-stressing of the O-ring 30. Thus, the support arm can be pivoted on the segment element 12, during the course of which the counter-denticulations 35 and 38 slide over the denticulations 14 while compressing the O-ring 30. Once the desired angular position has been attained, the sleeve nut 31 is tightened and returning the support arm half 21 to the position where it is braced against the support arm half 20.

In the course of this, the O-ring 30 is relieved. It is possible to adjust the pre-stress of the O-ring 30, and thus the retaining force between the denticulations 14 and the counter-denticulations 35 and 38, with the nut 29, when the sleeve nut 31 has been loosened. Displacement of the support arms can be accomplished by pushing or pulling the work surface. One advantage is that with the sleeve nut 31 loosened, the support arms can be pivoted and locked in pairs independently of each other. The sleeve nut 31 is supported on the support arm half 21 and, after tightening of the nut 26 on the threaded part 28, braces the counter-denticulations 35 and 38 of the support arm halves 20 and 21 with the denticulations 14 of the segment element 12. The sleeve nut 31 remains at a distance from the nut 29, so that the setting of the latter is maintained. The O-rings 30 are relieved in the braced position of the support arms.

The support arm halves 20 and 21 have, on their ends facing the cross brace 10 and the segment element 12, corresponding concave, circular-arc-shaped grooves, which are also aligned in the long axis of the cross brace 10 and form a receptacle for the facing rail of the segment element 12. The bottom of the groove in each case is embodied as a denticulation 14, and the rails have counter-denticulations 35 and 28 on their front faces. With the groove walls 34 and 36 or 37 and 39, the grooves enclose the facing rail of the segment element 12 and are in engagement with the counter-denticulations 35 and 38 of the support arm halves 20 and 21, which engagement cannot be changed when the bolt connection is tightened. The teeth and tooth gaps of the denticulations 14 and of the counter-denticulations 35 and 38 are aligned perpendicularly to the longitudinal axis of the cross brace 10 and are radially aligned toward the center which is the reference point for the circular arcs of the denticulations 14 and the counter-denticulations 35 and 38. The pitch of the teeth in this case is only about 0.5°, so that the assembled support arm can be pivoted in a stepped manner when the bolt connection is loosened. The pivot angle of the support arm of about 0.5° between steps results in a change in height of approximately 5 mm of the work surface. Once the new angular position of the support arm is set, the position is fixed by tightening the bolt connection, the denticulations 14 and counter-denticulations 35 and 38, which are in engagement with each other, preventing further pivoting of the support arm, even when the work surface support by the support arms is subjected to high loads.

In accordance with one embodiment of this invention, the denticulations 14 are disposed on the front faces of the groove walls 36 and 39. The counter-denticulations 35 and 38 are disposed on the circular-arc-shaped circumferential surfaces, which are disposed behind the rails, of the segment element 12.

However, the disposition of the denticulations 14 in the groove bottom and on the front faces of the rails is preferred. In accordance with one embodiment of this invention, only one support arm half, for example 20, has a counter-denticulation, for example 35, which is in engagement with a denticulation 14 on the front face of the facing rail. Tongues 40 and 41 are formed on the free ends of the support arm halves 20 and 21, which are hingedly connected to sliders which are adjustable in guide rails of the work surface.

In accordance with another embodiment of this invention, the two support arm halves are connected to each other by two bolt connections, one bolt connection of which is disposed, as illustrated, in the area of the ends with the grooves, and the other bolt connection of which is disposed in the area of the ends of the support arms halves 20 and 21 facing the work surface. For this purpose the support arm halves 20 and 21 form additional cup-shaped receptacles for the other bolt connection.

I claim:

1. In a work table or office desk with a work surface which is adjustable in height or inclination and is hingedly supported on a cross brace of a table frame by two pairs of pivotable support arms, each said support arm being vertically divided into two support arm halves and forming a concave groove in the shape of a section of an arc at their ends facing said cross brace, an undercut groove of each support arm half being aligned parallel to the cross brace and enclosing a convex, undercut rail of a segment element in the shape of a section of an arc and aligned parallel to the cross brace, said segment element being vertically aligned and laid out on a pivot area of the assembled support arm, and said two support arm halves of each said support arm being connected to each other by at least one bolt connection and being captively maintained on said segment element, the improvement comprising:

at least one said support arm half (20, 21) of each said support arm having a denticulation (35, 38) in an area of said concave groove, the associated segment element (12) having a counter-denticulation (14) which engages said denticulation (35, 38) of said support arm half (20, 21), and a pre-stressed resilient element having limited elasticity pulling said support arm halves (20, 21) against each other and adjustably maintaining a functional connection between said denticulation (14) and said counter-denticulations (35, 38) when said bolt connection is loosened.

2. In a work table or office desk in accordance with claim 1, wherein the teeth and the tooth gaps of said circular-arc-shaped denticulation (35, 38) of each of said support arm halves (20, 21) and said circular-arc-shaped counter-denticulations (14) of said segment elements (12) are oriented perpendicular to the longitudinal axis of said cross brace (10) and are radially aligned with respect to the center axis of said circular arcs of the denticulations (35, 38) and said counter-denticulations (14).

3. In a work table or office desk in accordance with claim 1, wherein said pre-stressed resilient element is maintained in a pre-stressed manner by a nut (29) on a threaded part (28) of a bolt (26) connecting said two support arm halves, and a sleeve nut (31) screwed on said threaded part (28) is supported in a receptacle (25) of the facing support arm half (21) and is at a distance from said nut (29).

4. In a work table or office desk in accordance with claim 1, wherein said denticulation (35, 38) of each said support arm half (20, 21) is disposed in a bottom of said concave grooves, and said counter-denticulation (14) of said segment element (12) is disposed on a front face of each of said rails.

5. In a work table or office desk in accordance with claim 4, wherein the teeth and the tooth gaps of said circular-arc-shaped denticulation (35, 38) of each of said support arm halves (20, 21) and said circular-arc-shaped counter-denticulations (14) of said segment elements (12) are oriented perpendicular to the longitudinal axis of said cross brace (10) and are radially aligned with respect to the center axis of said circular arcs of the denticulations (35, 38) and said counter-denticulations (14).

6. In a work table or office desk in accordance with claim 5, wherein said pre-stressed resilient element is maintained in a pre-stressed manner by a nut (29) on a threaded part (28) of a bolt (26) connecting said two support arm halves, and a sleeve nut (31) screwed on said threaded part (28) is supported in a receptacle (25) of the facing support arm half (21) and is at a distance from said nut (29).

* * * * *